US005080703A

United States Patent [19]

Rathbone

[11] Patent Number: 5,080,703

[45] Date of Patent: Jan. 14, 1992

[54] AIR SEPARATION

[75] Inventor: Thomas Rathbone, Farnham, United Kingdom

[73] Assignee: The BOC Group plc, Windlesham, England

[21] Appl. No.: 481,411

[22] Filed: Feb. 16, 1990

[30] Foreign Application Priority Data

Feb. 24, 1989 [GB] United Kingdom ..... 8904275

[51] Int. Cl.[5] ..... F25J 3/00

[52] U.S. Cl. ..... 62/38; 60/39.12; 62/44

[58] Field of Search ..... 62/11, 23, 24, 31, 32, 62/34, 36, 38, 42, 44; 60/39.12, 39.02

[56] References Cited

U.S. PATENT DOCUMENTS

| | | | |
|---|---|---|---|
| 3,731,495 | 5/1973 | Coveney . | |
| 4,224,045 | 9/1980 | Olszewski | 62/30 |
| 4,250,704 | 2/1981 | Brückner | 62/39.12 |
| 4,557,735 | 12/1985 | Pike . | |
| 4,705,548 | 11/1987 | Agrawal | 62/38 |
| 4,746,343 | 5/1988 | Ishizu | 62/43 |
| 4,854,954 | 8/1989 | Erickson . | |

FOREIGN PATENT DOCUMENTS 3643359 6/1988 Fed. Rep. of Germany .

2182785 12/1973 France .

*Primary Examiner*—Ronald C. Capossela

*Attorney, Agent, or Firm*—Robert I. Pearlman; Coleman R. Reap

[57] ABSTRACT

Compressed air is purified in apparatus 4 and passed through heat exchanger 6 in which it is reduced in temperature ready for rectification in a double column comprising a higher pressure rectification column 10 and a lower pressure rectification column 12 which are linked by a condenser-reboiler 14. The air is separated in the column 10 into oxygen-rich and nitrogen fractions. The oxygen-rich fraction is separated in the lower pressure column 12 into an oxygen and a lower pressure nitrogen product. Liquid nitrogen from the higher pressure column 10 is used as reflux in the lower pressure column 12, and a gaseous nitrogen stream is withdrawn from the column 10 as higher pressure nitrogen product. In order to compensate for the resulting loss of reflux in the column 12, a part of the lower pressure nitrogen product stream is compressed in compressor 38, cooled by passage through heat exchanger 6, and condensed in condenser 40. The resulting condensate provides additional reflux in the column 12. This arrangement makes possible enhanced power recovery from nitrogen produced in an air separation plant providing an oxygen product at an elevated pressure.

17 Claims, 2 Drawing Sheets

AIR SEPARATION

TECHNICAL FIELD

This invention relates to a method and apparatus for separating air and to the use of such methods and apparatus in processes which use oxygen product from the air separation in a chemical reaction, for example, oxidation (including combustion) and in which electrical power is also generated.

BACKGROUND OF THE PRIOR ART

There is an increasing demand for cryogenic air separation plants to produce very large quantities of oxygen for use for example in direct reduction steel making processes, coal-gasification processes, and partial oxidation processes in which natural gas is converted to synthesis gas.

Most modern commercial air separation plants employ a high pressure rectification column having its upper end in heat exchange relationship with the lower end of the lower pressure rectification column. Cold compressed air is separated into oxygen-enriched and nitrogen-enriched liquids in the higher pressure column, and these liquids are transferred to the lower pressure column for separation into nitrogen-enriched and oxygen-enriched products. Large quantities of energy are required to compress the feed air. U.S. Pat. No. 3 731 495 discloses a process for reducing the external power consumption of the process. The process employs a nitrogen-quenched power turbine. A portion of the compressed feed air is mixed with fuel and combusted. A hot combustion mixture is then quenched with waste nitrogen-rich gas from the lower pressure rectification column and the resulting gaseous mixture is expanded in a power turbine. The expansion provides energy to compress the feed air. A major disadvantage of this process is that the pressure of the gaseous mixture expanded in the power turbine can be no higher than that of the waste nitrogen mixed with the combustion gases. As pointed out in U.S. Pat. No. 4 224 045, commercially available power turbines have optimum inlet pressures in excess of the optimum operating pressure of the lower pressure rectification column. Accordingly, U.S. Pat. No. 4 224 045 proposes compressing waste nitrogen from the lower pressure rectification column prior to using it to quench the combustion mixture.

Additional work is thus required to compress the nitrogen from a pressure just above one atmosphere to a pressure in excess of ten atmospheres.

SUMMARY OF THE INVENTION

The apparatus and method according to the invention make possible a reduction in the work that needs to be performed in compressing nitrogen.

According to the present invention there is provided a method of separating air comprising:

(a) removing carbon dioxide and water vapour from a compressed air feed stream and reducing the temperature of at least part of the thus purified feed stream to a level suitable for its separation by rectification at cryogenic temperatures., (b) introducing the thus cooled air stream into a higher pressure rectification column, providing liquid nitrogen reflux for the higher pressure rectification column, and separating the air therein into oxygen-enriched and nitrogen-enriched fractions;

(c) withdrawing a liquid stream of oxygen-enriched fraction from the higher pressure column and passing it into a lower pressure rectification column in which it is separated into oxygen and nitrogen;

(d) withdrawing a nitrogen stream and a product oxygen stream from the lower pressure rectification column;

(e) withdrawing a liquid stream of nitrogen-enriched fraction from the higher pressure column and employing it as reflux in the lower pressure column., (f) reboiling liquid oxygen in or from the lower pressure column;

(g) taking at least part of the said nitrogen stream, compressing it. cooling it, at least partially condensing it, and employing the resulting liquid nitrogen as additional reflux in the lower pressure column; and (h) withdrawing a gaseous product stream of said nitrogen-enriched fraction from the higher pressure column. The invention also provides apparatus for separating air, comprising:

(a) means for separating carbon dioxide and water vapour from a compressed feed air stream;

(b) heat exchange means for reducing the temperature of at least part of the thus purified air stream to be level suitable for separation by cryogenic rectification;

(c) a higher pressure rectification column in communication with the lower temperature end of the passage through the heat exchange means for the air stream; the higher pressure rectification column having an inlet for liquid nitrogen reflux, an outlet for a stream of nitrogen-enriched fraction and another outlet for a liquid stream of oxygen-enriched fraction, (d) a lower pressure rectification column having an inlet in communication with the said outlet for the liquid stream of oxygen-enriched fraction and having outlets for separate oxygen and nitrogen streams;

(e) means for reboiling liquid oxygen in or from the lower pressure column;

(f) a compressor for compressing a stream of warmed nitrogen-enriched fraction, and (g) a condenser for condensing said compressed nitrogen stream and means for combining the resulting liquid nitrogen with the liquid nitrogen reflux.

By recycling nitrogen from the lower pressure column, and using it to form reflux for that column. it becomes possible, in comparison with comparable known processes, to withdraw more high pressure nitrogen from the higher pressure column. Hork may be recovered from this nitrogen, and from the low pressure nitrogen, for example by compressing it and then employing it to moderate the temperature in or down stream of a gas turbine employed to generate electrical power.

The method and apparatus according to the invention are particularly suited for use when the inlet pressure of the feed air stream is in the range of 8 to 15 atmospheres absolute and particularly when this pressure is in the range of 8 to 13 atmospheres absolute. Although taking some of the nitrogen enriched fraction as a gaseous product stream for the recovery of work reduces the rate at which nitrogen can be condensed to form reflux, for the lower pressure column, this reduction may be compensated for at least in part by the recycling of nitrogen taken from the lower pressure column in accordance with the invention such that there is a net saving in the amount of compression of nitrogen that needs to be done.

Condensation of the compressed nitrogen stream is preferably effected by heat exchange with liquid oxygen-enriched fraction from the higher pressure column. The oxygen is itself vaporised and the resulting vapour is preferably introduced into the lower pressure column.

BRIEF DESCRIPTION OF THE DRAWINGS

The method and apparatus according to the invention will now be described by way of example with reference to the accompanying drawings in which.

DETAILED DESCRIPTION OF THE INVENTION

Figure 1:
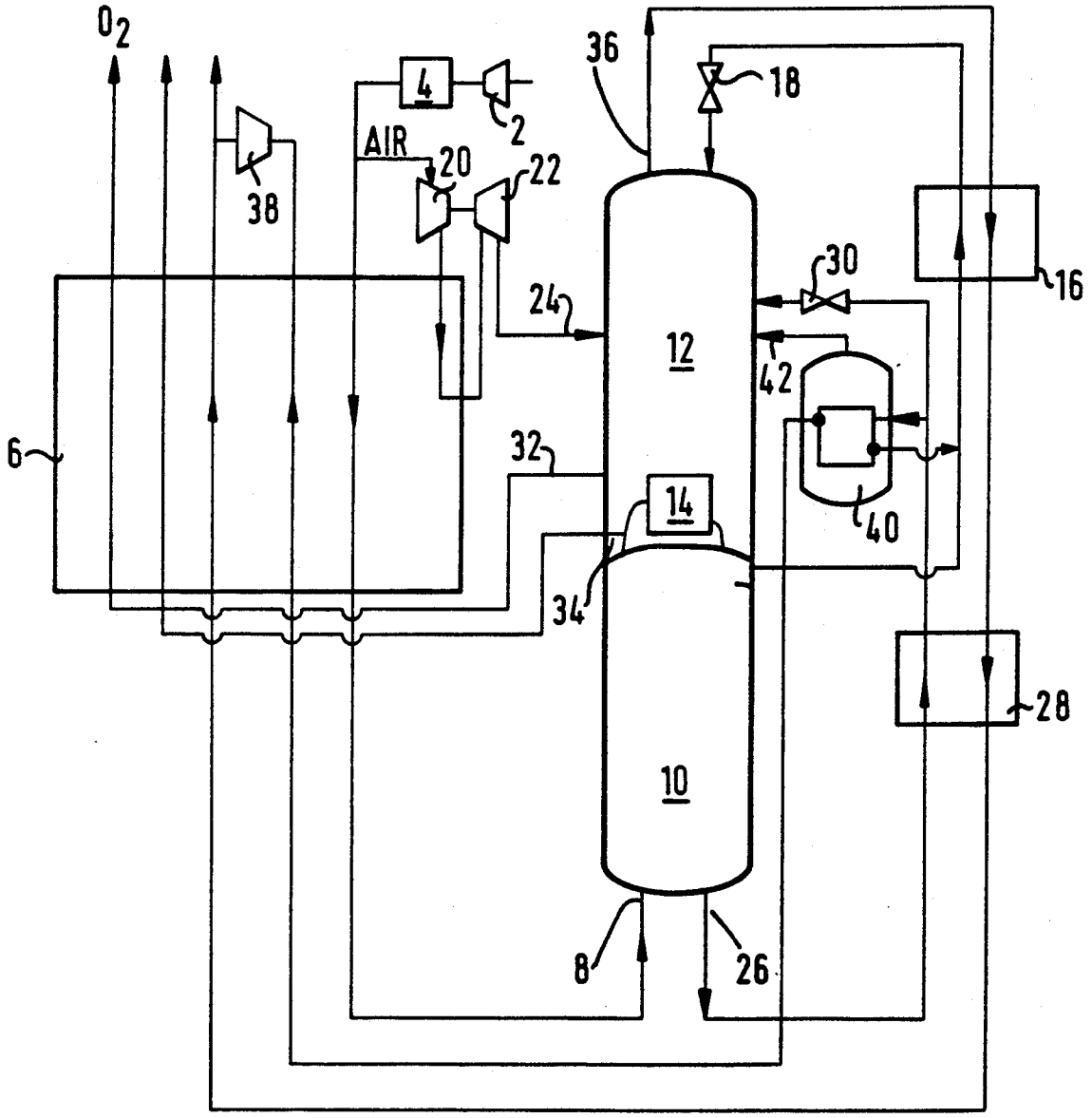
FIG. 1 is a schematic flow diagram of apparatus for separating air.

Referring to FIG. 1 of the drawings, air is supplied at a pressure of 10.9 bar from the outlet of an air compressor (not shown in FIG. 1) forming part of a gas turbine (also not shown in FIG. 1). The air is passed through a purification apparatus 4 effective to remove water vapour and carbon dioxide from the compressed air. The apparatus 4 is of the kind which employs beds of adsorbent to adsorb water vapour and carbon dioxide from the incoming air. The beds may be operated out of sequence with one another such that while one bed is being used to purify air the other is being regenerated. typically by means of a stream of nitrogen. The purified air stream is then divided into major and minor streams.

The major stream passes through a heat exchanger 6 in which its temperature is reduced to a level suitable for the separation of the air by cryogenic rectification. Typically therefore the major air stream is cooled to its saturation temperature at the prevailing pressure. The major air stream is then introduced through an inlet 8 into a higher pressure rectification column 10 in which it is separated into oxygen-enriched and nitrogen fractions.

The higher pressure rectification column forms part of a double column arrangement. The other column of the double column arrangement is a lower pressure rectification column 12. Both rectification columns 10 and 12 contain liquid vapour contact trays and associated downcomers (or other means) whereby a descending liquid phase is brought into intimate contact with an ascending vapour phase such that mass transfer occurs between the two phases. The descending liquid phase becomes progressively richer in oxygen and the ascending vapour phase progressively richer in nitrogen. Typically, the higher pressure rectification column 10 operates at a pressure substantially the same as that to which the incoming air is compressed. The column 10 is preferably operated so as to give a substantially pure nitrogen fraction at its top but an oxygen fraction at its bottom which still contains a substantial proportion of nitrogen.

The columns 10 and 12 are linked together by a condenser-reboiler 14. The condenser-reboiler 14 receives nitrogen vapour from the top of the higher pressure column 10 and condenses it by heat exchange with boiling liquid oxygen in the column 12. The resulting condensate is returned to the higher pressure column 10. Part of the condensate provides reflux for the column 10 while the remainder is collected, sub-cooled in a heat exchanger 16 and passed into the top of the lower pressure column 12 through an expansion valve 18 and thereby provides reflux for the column 12.

The lower pressure rectification column typically operates at a pressure in the order of 3.3 bar and receives oxygen-nitrogen mixture for separation from two sources. The first source is the minor air stream formed by dividing the stream of air leaving the purification apparatus 4. The minor air stream upstream of its introduction into the column 12 is first compressed in a compressor 20 typically to a pressure of about 20 bar, is then cooled to a temperature of about 200 K in the heat exchanger 6, is withdrawn from the heat exchanger 6 and is expanded in an expansion turbine 22 to the operating pressure of the column 12. thereby providing refrigeration for the process. This air stream is then introduced into the column 12 through inlet 24. If desired, the expansion turbine 22 may be employed to drive the compressor 20, or alternatively the two machines, namely the compressor 20 and the turbine 22, may be independent of one another. The independent arrangement is often preferred since it enables the outlet pressure of both machines to be set independently of one another.

The second source of oxygen-nitrogen mixture for separation in the column 12 is a liquid stream of oxygen-enriched fraction taken from the bottom of the higher pressure column 10. This stream is withdrawn through the outlet 26, is sub-cooled in a heat exchanger 28, and one part of it is then passed through a Joule-Thomson valve 30 and flows into the column 12.

The apparatus shown in the drawing produces three product streams. The first is a gaseous oxygen product stream which is withdrawn from the bottom of the lower pressure column 12 through an outlet 32. This stream is then warmed to at or near ambient temperature in the heat exchanger 6 by countercurrent heat exchange with the incoming air. The oxygen may for example be used in a gasification, steel making or partial oxidation plant. Two nitrogen product streams are additionally taken. The first nitrogen product stream is taken as vapour from the nitrogen-enriched fraction (typically substantially pure nitrogen) collecting at the top of the column 10. This nitrogen stream is withdrawn through the outlet 34 and is warmed to approximately ambient temperature by countercurrent heat exchange with the air stream in the heat exchanger 6. The nitrogen stream typically leaves the heat exchanger 6 at a pressure of 10.5 bar. The nitrogen stream is further compressed in a compressor (not shown in FIG. 1) and is then supplied to a gas turbine (not shown in FIG. 1) so as to control the temperature therein. Alternatively, other means may be used to recover work from this nitrogen stream. If desired, a part of the 10.5 bar nitrogen stream may be taken as a separate product and not passed to the gas turbine. By withdrawing a nitrogen stream from the higher pressure column 10 through the outlet 34, the amount of reflux made available to the lower pressure column 12 from the higher pressure column 10 is reduced. This reduction in reflux may be in part compensated for in accordance with the invention as shall be described below.

The other nitrogen product stream is taken directly from the top of the lower pressure column 12 through an outlet 36. This nitrogen stream flows through the heat exchanger 16 countercurrently to the liquid nitrogen stream withdrawn from the higher pressure column and effects the sub-cooling of this stream. The nitrogen product stream then flows through the heat exchanger 28 countercurrently to the liquid stream of oxygen-enriched fraction and effects the sub-cooling of this liquid stream. The nitrogen stream taken from the top of the column 12 then flows through the heat exchanger 6 countercurrently to the major air stream and is thus warmed to approximately ambient temperature. This nitrogen stream leaves the heat exchanger 6 at a pressure of 3.1 bar. It is then divided into two parts. One part is taken as product at 3.1 bar. Some or all of this part of the product stream is typically used to purge the adsorbent beds of water vapour and carbon dioxide in the purification apparatus 4. Such use of nitrogen, which is typically pre-heated (by means not shown), is well known in the art. Notwithstanding its use to purge the purification apparatus 4 of water and carbon dioxide, the 3.1 bar product nitrogen stream may itself be supplied to the gas turbine (not shown in FIG. 1) to moderate the temperature therein. Accordingly this nitrogen stream is further compressed downstream of the purification apparatus 4. The remainder of the nitrogen stream is to form additional reflux for the lower pressure 12. This is done by taking a part of the 3.1 bar stream of nitrogen leaving the warm end of the heat exchanger 6 through a compressor 38 in which its pressure is raised to a level intermediate the operating pressures of the columns 10 and 12, eg to 6.7 bar. The nitrogen stream then passes all the way through the heat exchanger 6 co-currently with the major air stream. This compressed nitrogen stream then flows through a condenser-reboiler 40 in which it is condensed. The resulting liquid is mixed with the stream of liquid nitrogen withdrawn from the higher pressure column 10, such mixing being performed upstream of the heat exchanger 16. Condensing of the nitrogen stream in the condenser-reboiler is effected by a part of the sub-cooled liquid stream of oxygen-enriched fraction withdrawn from the column 10. This liquid is itself vaporised in the condenser-reboiler 40 and the resulting vapour is passed into the column 12 through an inlet 42.

Figure 2:
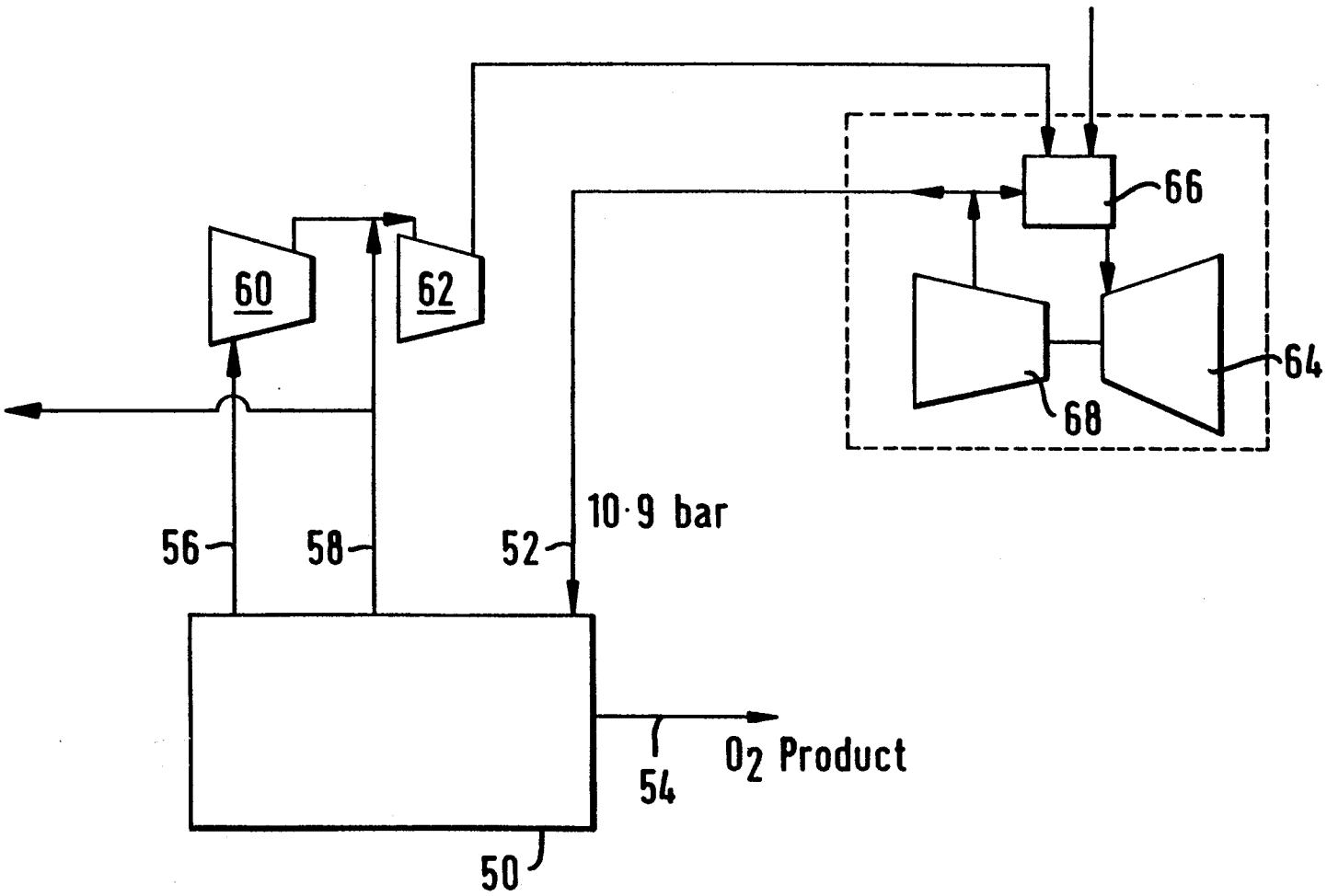
FIG. 2 is a schematic circuit drawing showing the integration of the apparatus shown in FIG. 1 with a gas turbine.

The relationship between the air separation plant shown in FIG. 1 and the gas turbine is shown in FIG. 2. The air separation plant is shown only generally and is indicated by the reference 50. It has an inlet 52 for an air stream at 10.9 bar, an outlet 54 for an oxygen product stream, an outlet 56 for a low pressure (3.1 bar) nitrogen stream, and an outlet 58 for a high pressure (10.5 bar) nitrogen stream. The low pressure nitrogen stream. which is typically laden with water vapour and carbon dioxide, having been used to purge the air purification apparatus forming part of the plant 50, is compressed in a compressor 60 to the pressure of the high pressure nitrogen stream. It is then mixed with a major portion of that stream. (The remainder of the high pressure stream is typically taken as a separate product from upstream of where the mixing takes place.) The mixed stream is then further compressed in a compressor 62 to the operating pressure of the combustion chamber 66 of a gas turbine 64 typically used to generate electricity. The turbine 64 is coupled to and thus drives an air compressor 68 which takes in air and compressors it to the operating pressure of the combustion chamber 66. A major part of the resulting compressed air is supplied to the combustion chamber 66 while the remainder forms the air supply to the air separation plant 50. A fuel gas is supplied through an inlet 70 to the combustion chamber 66. It undergoes combustion in the chamber 66, the combustion being supported by the air supplied from the compressor 68. The nitrogen leaving the compressor 62 is also supplied to the combustion chamber 66 so as to moderate the temperature therein.

I claim:

1. A method of separating said comprising:

(a) removing carbon dioxide and water vapour from a compressed air feed stream taken from the air feed to the combustion chamber of a gas turbine and reducing the temperature of at least part of the thus purified feed stream to a level suitable for its separation by rectification at cryogenic temperatures;

(b) introducing the thus cooled air stream into a higher pressure rectification column, providing liquid nitrogen reflux for the higher pressure rectification column, and separating the air therein into oxygen-enriched and nitrogen-enriched fractions;

(c) withdrawing a liquid stream of oxygen-enriched fraction from the higher pressure column a nd passing it into a lower pressure ratification column in which it is separated into oxygen and nitrogen;

(d) withdrawing a nitrogen stream and a product oxygen stream from the lower pressure rectification column;

(e) withdrawing a liquid stream of nitrogen-enriched fraction from the higher pressure column and employing it as reflux in the lower pressure column;

(f) boiling liquid oxygen separated in the lower pressure column;

(g) taking at least part o the said nitrogen steam of step (d)m, compressing it, scooping it, at least partially condensing it, and employing the resulting liquid nitrogen as additional reflux in the lower pressure column; and (h) withdrawing a gaseous product stream of said nitrogen-enriched fraction from the higher pressure column.

2. A method as claimed in claim 1, in which the compressed air fed stream is at a pressure in the range of 8 to 15 atmospheres absolute.

3. A method as claimed in claim 2, in which h compressed said feed stream is at a pressure in the range of 8 to 13 atmospheres absolute.

4. A method as claimed in claim 2, in which at least part of the said gaseous product stream of said nitrogen-enriched fraction is further compressed and then has power recovered from it.

5. A method as claimed in claim 4, in which power is recovered from the further compressed gaseous product stream in a gas turbine.

6. A method as claimed in claim 2, in which part of the nitrogen stream withdrawn from eh lower pressure column is employed to purge water and carbon dioxide from apparatus used to remove such water and carbon dioxide from the compressed air feed stream.

7. A method as claimed in claim 2, in which at least part of the nitrogen stream withdrawn for the lower pressure column is further compressed and then has power recovered from it.

8. A method as claimed in claim 7, in which power is recovered form the further compressed nitrogen steam in a gas turbine.

9. A method as claim din claim 2, in which the art least partial condensation of said part of the nitrogen stream is effected by heat exchange with part of said oxygen-enriched liquid stream, the oxygen-rich liquid being itself reboiled and then introduced into the lower pressure column.

10. Apparatus for separating air, comprising:

(a) means for separating carbon dioxide and water vapour from a compressed feed air stream, said means having an inlet communicating with the outlet of an air compressor adapted to supply air to a combustion chamber of a gas turbine;

(b) heat exchange means for reducing the temperature of at least part of the thus purified pair stream to a leave suitable for separation by cryogenic rectification;

(c) a higher pressure rectification column in communication with the lower temperature end of the passage through the heat exchange means for the air stream; at the higher pressure rectification column having an inlet for liquid nitrogen reflux, an outlet for a stream of nitrogen-enriched fraction and another outlet for a stream of nitrogen-enriched fraction and another outlet for a liquid steam of oxygen-enriched fraction;

(d) a lower pressure rectification column having an inlet in communication with the said outlet for the liquid stream of oxygen-enriched fraction and having outlets for separate oxygen and nitrogen streams;

(e) means for reboiling liquid oxygen separated in the lower pressure column;

(f) a compressor for compressing a stream of warmed nitrogen-enriched fraction; and (g) a condenser for condensing said compressed nitrogen stream and means for combining the resulting liquid nitrogen with the liquid nitrogen reflux.

11. Apparatus as claimed in claim 10, in which the combustion chamber is adapted to receive at least part of the said stream of nitrogen-enriched fraction.

12. Apparatus as claimed in claim 11, including a further compressor for compressing said part o the said stream of nitrogen-enriched fraction upstream of said combustion chamber.

13. Apparatus as claimed in claim 10, additionally including an expansion turbine for expanding a minor part of the purified air stream, said turbine having an outlet communicating with the lower pressure rectification column.

14. A method of separating air comprising:

(a) removing carbon dioxide and water vapour from a compressed air feed stream and reducing the temperature of at least part of the thus purified feed stream to a level suitable for its separation by rectification at cryogenic temperatures;

(b) introducing the thus cooled air stream into a higher pressure rectification column, providing liquid nitrogen reflux of the higher pressure rectification column, and separating the air therein into oxygen-enriched and nitrogen-enriched fractions;

(c) withdrawing a liquid stream of oxygen-enriched fraction from the higher pressure column and passing it into a lower pressure rectification column in which it is separated into oxygen and nitrogen;

(d) withdrawing a nitrogen stream and a product oxygen steam from the lower pressure rectification column;

(e) withdrawing a liquid stream of nitrogen-enriched fraction from the higher pressure column and employing it as reflux in the lower pressure column;

(f) reboiling liquid oxygen separated i the lower pressure column;

(g) taking at least part of the said nitrogen stream of step (d), compressing it, cooling its, at least partially condensing it by heat exchange with part f the oxygen-enriched fraction of step (c) in a condenser-reboiler, and employing the resulting liquid nitrogen as additional reflux in the lower pressure column, aid part of the oxygen-enriched fraction being reboiled and then introduced into the lower pressure column; and (h) withdrawing and gaseous product stream of said nitrogen-enriched fraction for the the higher pressure column.

15. A method as claimed in claim 14, in which refrigeration is generated by expanding a minor part of the purified compressed air stream in a turbine, at least part of the resulting expanded air being introduced into the lower pressure column.

16. A method as claimed in claim 14, in which the air feed stream is taken of the air feed to the combustion chamber of a gas turbine.

17. Apparats for separating air, comprising:

(a) means for separating carbon dioxide and water vapour from a compressed feed air stream;

(b) heat exchange means for reducing the temperature of a least part of the thus purified air stream to a level suitable for separation by cryogenic rectification;

(c) a higher pressure rectification column in communication with the lower temperature end of the passage through the heat exchange means or the air stream; at the higher pressure rectification column having an inlet for liquid nitrogen reflux, an outlet for a stream of nitrogen-enriched fraction, another outlet for a stream of nitrogen-enriched fraction and an outlet for a liquid stream of oxygen-enriched fraction;

(d) a lower pressure rectification column having an inlet in communication with said outlet for the liquid stream of oxygen-enriched fraction and having outlets for separate oxygen and nitrogen streams;

(e) means for reboiling liquid oxygen separated in the lower pressure column;

(f) a compressor for compressing a stream of warmed nitrogen-enriched fraction;

(g) a condenser-reboiler adapted to condense at least part of said compressed nitrogen stream and reboil a part of the liquid oxygen-enriched fraction from said high pressure rectification column;

(h) means for combining the resulting liquid nitrogen with the liquid nitrogen reflux; and (i) means for introducing said reboiled liquid oxygen-enriched fraction into said lower pressure column.

* * * * *

UNITED STATES PATENT AND TRADEMARK OFFICE

CERTIFICATE OF CORRECTION

PATENT NO. : 5,080,703

DATED : 14 January 1992

INVENTOR(S) : Rathbone

It is certified that error appears in the above—identified patent and that said Letters Patent is hereby corrected as shown below:

Column 6, line 7: replace "said" and substitute --air--

Column 6, line 21: replace "a nd" and substitute --and--

Column 6, line 30: replace "boiling" and substitute --reboiling--

Column 6, line 32: replace "o" and substitute --of--

Column 6, line 33: after "(d)" delete "m"

Column 6, line 33: replace "scooping" and substitute --cooling--

Column 6, line 41: replace "fed" and substitute --feed--

Column 6, line 43: replace "h" and substitute --the--

Column 6, line 44: replace "said" and substitute --air--

Column 6, line 54: replace "eh" and substitute --the--

Column 6, line 59: replace "for" and substitute --from--

Column 6, line 63: replace "form" and substitute --from--

Column 6, line 65: replace "claim din" and substitute --claimed in--

UNITED STATES PATENT AND TRADEMARK OFFICE

CERTIFICATE OF CORRECTION

PATENT NO. : 5,080,703

DATED : 14 January 1992

INVENTOR(S) : Rathbone

It is certified that error appears in the above—identified patent and that said Letters Patent is hereby corrected as shown below:

Column 6, line 65: replace "art" and substitute --at--

Column 7, line 10: replace "pair" and substitute --air--

Column 7, line 11: replace "leave" and substitute --level--

Column 7, line 16: after "stream;" delete "at"

Column 7, line 39: replace "o" and substitute --of--

Column 7, line 55: replace "of" and substitute --for--

Column 8, line 7: replace "i" and substitute --in--

Column 8, line 10: replace "its" and substitute --it--

Column 8, line 11: replace "f" and substitute --of--

Col. 8, line 18, after "withdrawing" delete "and" and insert --a--

Column 8, line 19: replace "for" and substitute --from--

Column 8, line 19: after "the" delete "the"

Column 8, line 27: replace "of" and substitute --from--

Column 8, line 29: replace "Apparats" and substitute --Apparatus--

UNITED STATES PATENT AND TRADEMARK OFFICE

CERTIFICATE OF CORRECTION

PATENT NO. : 5,080,703

DATED : 14 January 1992

INVENTOR(S) : Rathbone

It is certified that error appears in the above—identified patent and that said Letters Patent is hereby corrected as shown below:

Column 8, line 33: replace "a" and substitute --at--

Column 8, line 38: replace "or" and substitute --for--

Column 8, line 39: after "stream;" delete "at"

Signed and Sealed this

Twenty-sixth Day of October, 1993

Bruce Lehman

*Attest:*

BRUCE LEHMAN

*Attesting Officer*

*Commissioner of Patents and Trademarks*